US007959478B2

(12) United States Patent
Chiu et al.

(10) Patent No.: US 7,959,478 B2
(45) Date of Patent: Jun. 14, 2011

(54) USB CONNECTOR AND ITS FABRICATION METHOD

(75) Inventors: Wen-Ta Chiu, Taipei Hsien (TW); Ming-Hui Yen, Taipei Hsien (TW); Chun-Ming Lai, Taipiei Hsien (TW); Yeh-Hsi Lin, Taipei Hsien (TW)

(73) Assignee: Chant Sincere Co., Ltd., Hsichih, Taipei Hsien (TW)

( * ) Notice: Subject to any disclaimer, the term of this patent is extended or adjusted under 35 U.S.C. 154(b) by 93 days.

(21) Appl. No.: 12/579,813

(22) Filed: Oct. 15, 2009

(65) Prior Publication Data

US 2010/0112862 A1 May 6, 2010

(30) Foreign Application Priority Data

Nov. 3, 2008 (TW) ..... 97142429 A

(51) Int. Cl.
*H01R 9/24* (2006.01)

(52) U.S. Cl. ..... 439/885; 439/937

(58) Field of Classification Search ..... 439/885, 439/937

See application file for complete search history.

(56) References Cited

U.S. PATENT DOCUMENTS

| | | | | |
|---|---|---|---|---|
| 5,060,372 | A * | 10/1991 | Capp et al. | 29/883 |
| 5,415,568 | A * | 5/1995 | Kinoshita | 439/607.5 |
| 5,975,959 | A * | 11/1999 | Joly | 439/630 |
| 6,171,149 | B1 * | 1/2001 | van Zanten | 439/607.07 |
| 6,764,336 | B2 * | 7/2004 | Ma et al. | 439/604 |
| 6,796,852 | B2 * | 9/2004 | Okamoto | 439/736 |
| 7,682,207 | B2 * | 3/2010 | Clark | 439/885 |
| 7,708,608 | B2 * | 5/2010 | Soh | 439/862 |
| 2002/0061686 | A1 * | 5/2002 | Ma et al. | 439/736 |
| 2010/0112862 | A1 * | 5/2010 | Chiu et al. | 439/607.23 |
| 2010/0159751 | A1 * | 6/2010 | Chiu et al. | 439/660 |

* cited by examiner

*Primary Examiner* — James Harvey

(74) *Attorney, Agent, or Firm* — Muncy, Geissler, Olds & Lowe, PLLC

(57) ABSTRACT

A USB connector fabrication method includes the steps of (a) stamping a metal sheet into a terminal set having a set of first terminals, a set of second terminals and material bridges joining the first terminals and the second terminals, (b) preparing an electrically insulative housing having punch holes and then mounting the terminal set in the electrically insulative housing to keep the material bridges in vertical alignment with the punch holes, (c) using a machine to cut off the material bridges and (d) securing a metal shield around the periphery of the electrically insulative housing.

19 Claims, 13 Drawing Sheets

USB CONNECTOR AND ITS FABRICATION METHOD

BACKGROUND OF THE INVENTION

1. Field of the Invention

The present invention relates to USB connector fabrication technology and more particularly, to a USB connector fabrication method, which simplifies USB manufacturing process and facilitates installation, saving much fabrication time and installation cost.

2. Description of the Related Art

Following fast development of modern technology, many different advanced electronic devices have been intensively used in our daily life. Further, different transmission cables are used for data transmission among different electronic devices. Serial transmission connectors, such as USB (Universal Serial Bus) 1.1 and 2.0, are intensively used in different electronic devices to provide transmission speeds 1.5 Mbit/s and 480 Mbit/s respectively. Nowadays, these data transmission speeds cannot satisfy the demand for quick transmission of a big amount of data within a limited time. In consequence, high speed data transmission connectors have been continuously created. For example, USB 3.0 provides a transmission speed as high as 5 Gbit/s. In consideration of compatibility to conventional USB 1.1 or 2.0, USB 3.0 maintains the original metal terminals and adds an extra set of metal terminals, i.e. a USB 3.0 connector has two sets of metal terminals arranged therein. These two sets of metal terminals are separately made from two different metal sheets by a stamping technique and separately bent into shape. After preparation of the two different sets of metal terminals, they are put in an insert-molding mold and molded in an electrically insulative housing. After molding, a metal shield is secured around the periphery of the electrically insulative housing, and a USB 3.0 connector is thus obtained.

The aforesaid conventional USB 3.0 connector fabrication method has drawbacks as follows:

1. Two separate stamping dies are needed for stamping two metal sheets into two different sets of metal terminals, increasing die cost and die preparation time.
2. Because the two different sets of metal terminals are separately prepared from two different metal sheets, much metal sheet waste material is produced during mass production of the two different sets of metal terminals. After preparation of the two different sets of metal terminals, the two different sets of metal terminals must be separately put in the insert-molding mold for molding, complicating the fabrication process and time.

Therefore, it is desirable to provide a USB connector fabrication method, which eliminates the aforesaid drawbacks.

SUMMARY OF THE INVENTION

The present invention has been accomplished under the circumstances in view. It is one object of the present invention to provide a USB connector fabrication method, which eliminates the problem of creating two different dies for making two different sets of terminals to fit USB 3.0 standard, saving much die cost. It is another object of the present invention to provide a USB connector fabrication method, which simplifies USB manufacturing process, saving much fabrication time and installation cost.

To achieve these and other objects of the present invention, a USB connector fabrication method comprises the steps of (a) stamping a metal sheet into a terminal set having a set of first terminals, a set of second terminals and material bridges joining the first terminals and the second terminals, (b) preparing an electrically insulative housing having punch holes and then mounting the terminal set in the electrically insulative housing to keep the material bridges in vertical alignment with the punch holes, (c) using a machine to cut off the material bridges and (d) securing a metal shield around the periphery of the electrically insulative housing.

To achieve these and other objects of the present invention, a USB connector comprises an electrically insulative housing, a terminal set and a metal shield. The electrically insulative housing defines a receiving space, a plurality of suspension slots arranged in a parallel manner in communication with the receiving space and at least one punch hole in communication with the receiving space. The terminal set is mounted in the electrically insulative housing, comprising a set of first terminals, a set of second terminals and a plurality of material bridges joining the first terminals and the second terminals and aimed at the at least one punch hole of the electrically insulative housing for cutting by an external tool means after installation of the terminal set in the electrically insulative housing. The first terminals and the second terminals are alternatively arranged in a row and connected to one another by the material bridges, each having a narrow elongated base portion, a rear bonding end portion backwardly extended from a rear end of the narrow elongated base portion and a front contact end portion forwardly extended from a front end of the narrow elongated base portion. The metal shield is secured around the periphery of the electrically insulative housing, having an opening in communication with the receiving space of the electrically insulative housing.

Further, an electrically insulative holding down block is arranged on the top side of the electrically insulative housing to hold down the rear bonding end portions of the first terminals and the second terminals on a same plane to facilitate bonding of the rear bonding end portions of the first terminal and the second terminal to an external cable or circuit board.

DETAILED DESCRIPTION OF THE PREFERRED EMBODIMENT

Figure 1:
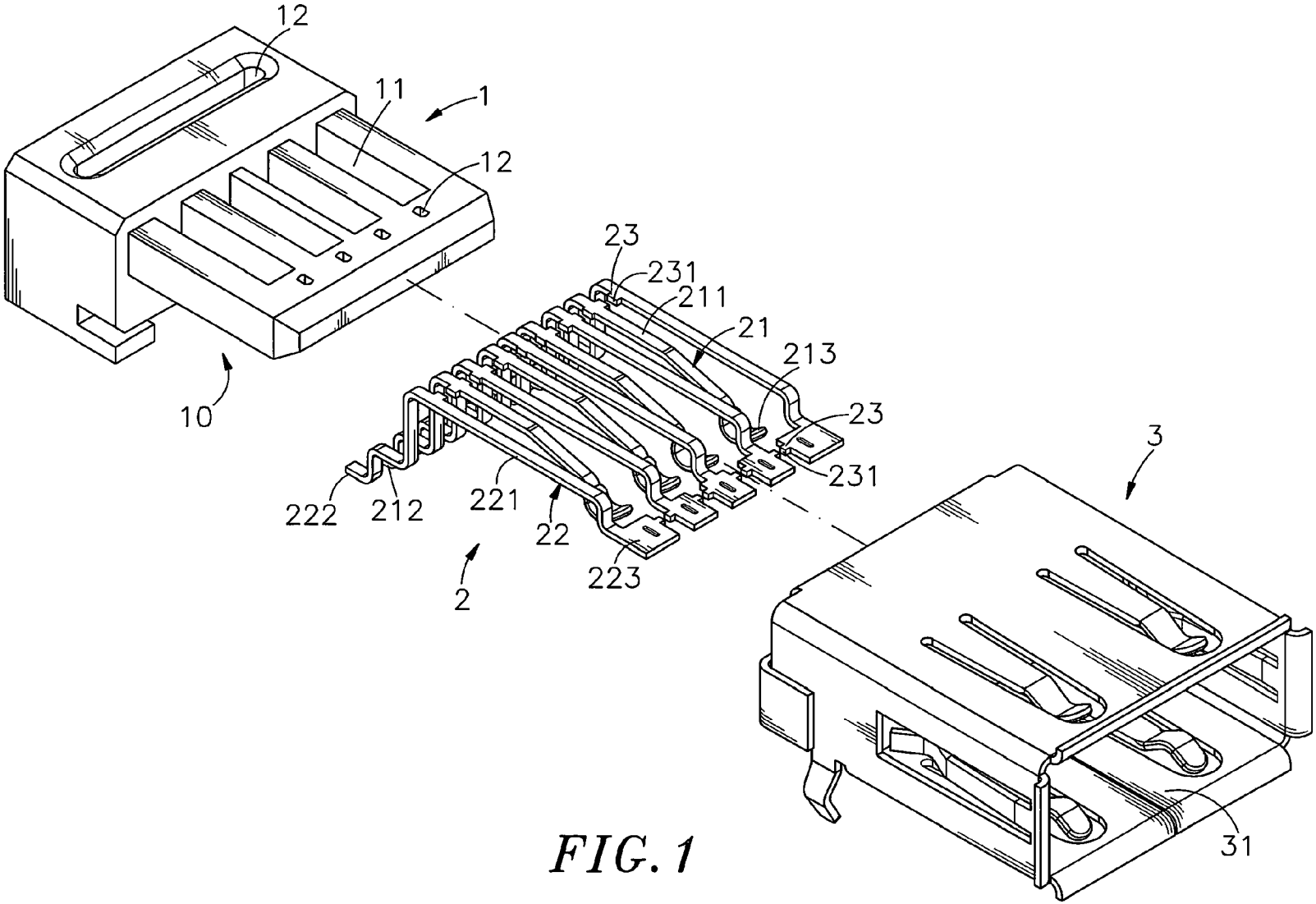
FIG. 1 is an exploded view of a USB connector in accordance with a first embodiment of the present invention.
Figure 2:
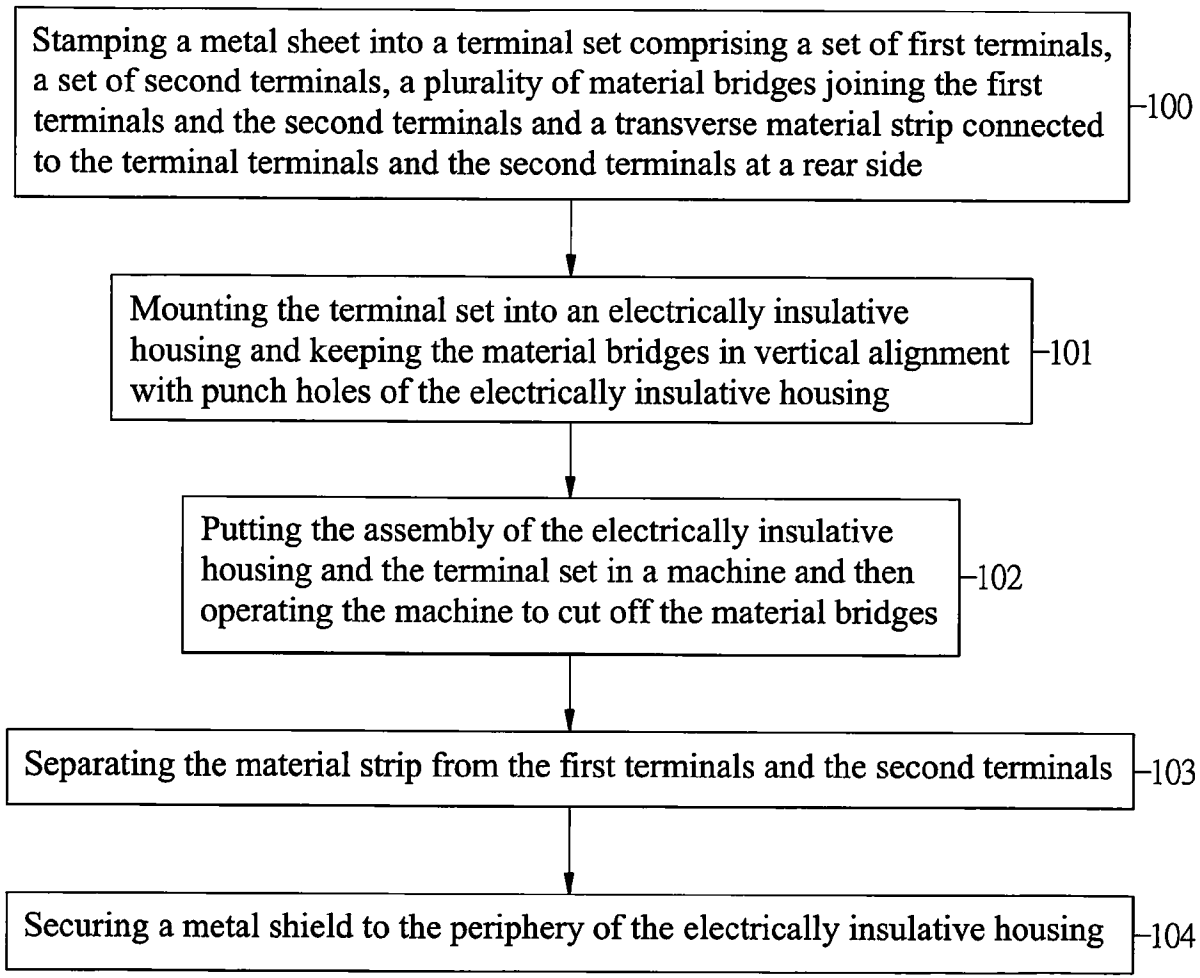
FIG. 2 is a USB connector manufacturing flow chart according to the present invention.
Figure 3:
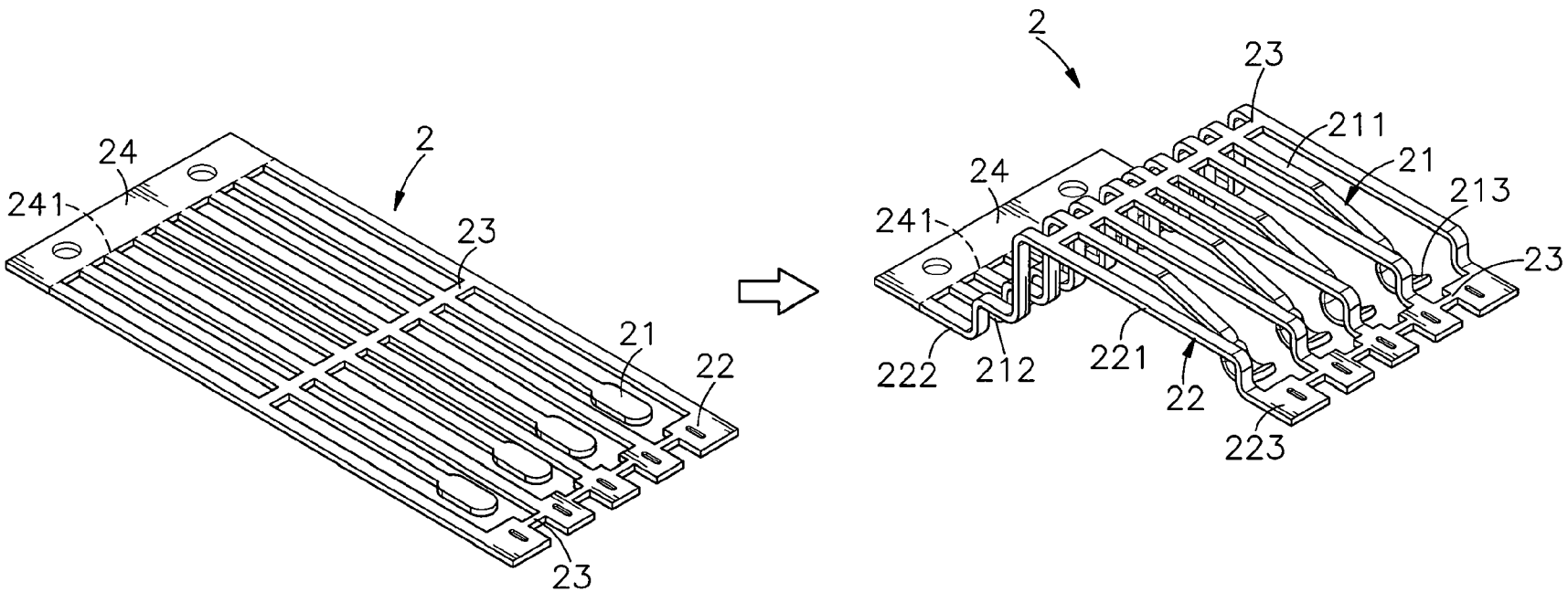
FIG. 3 is a schematic drawing of a part of the first embodiment of the present invention, showing a terminal set bent into shape.
Figure 4:
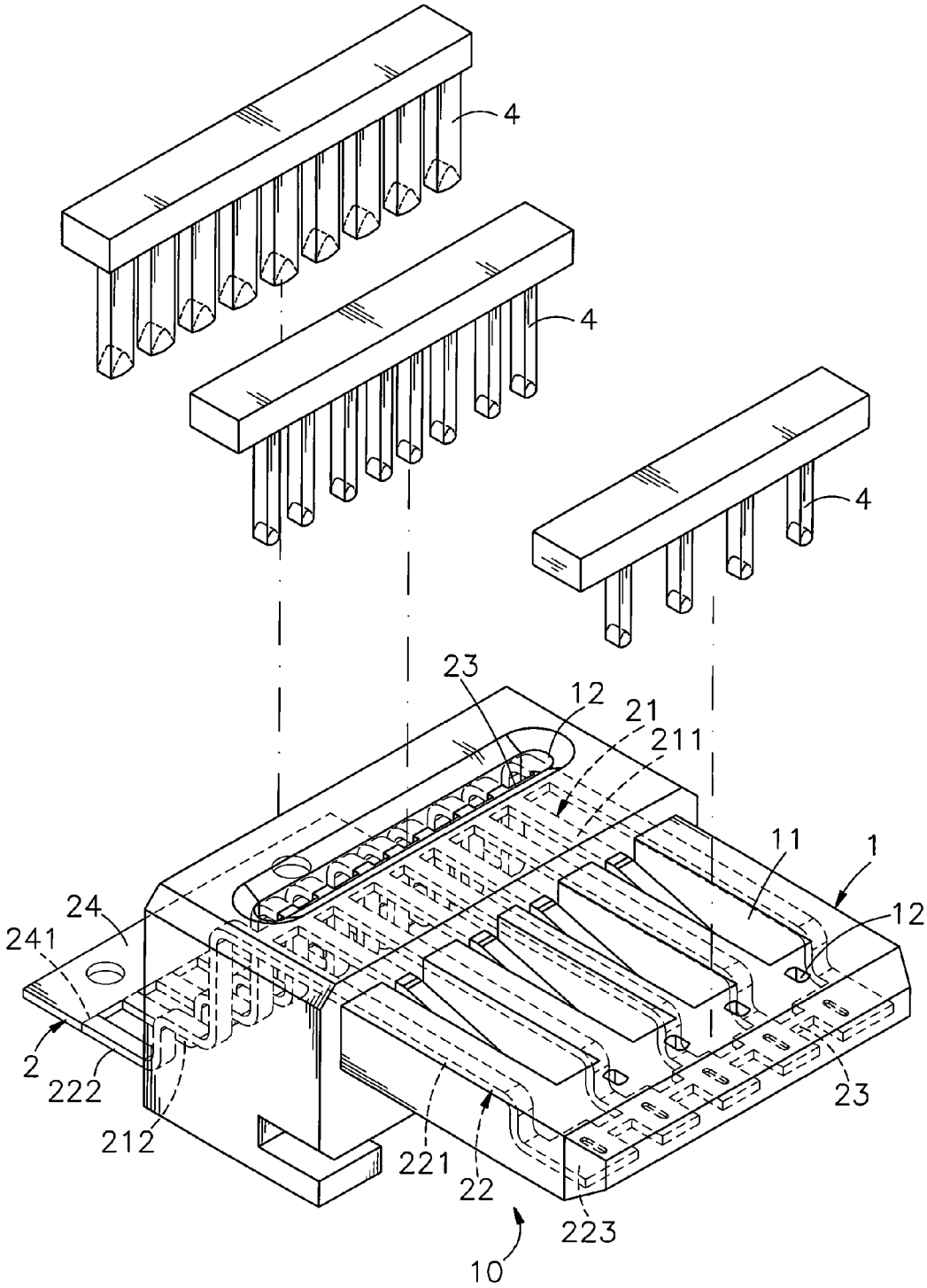
FIG. 4 is a schematic drawing, showing a step of the fabrication of the USB connector according to the first embodiment of the present invention.
Figure 5:
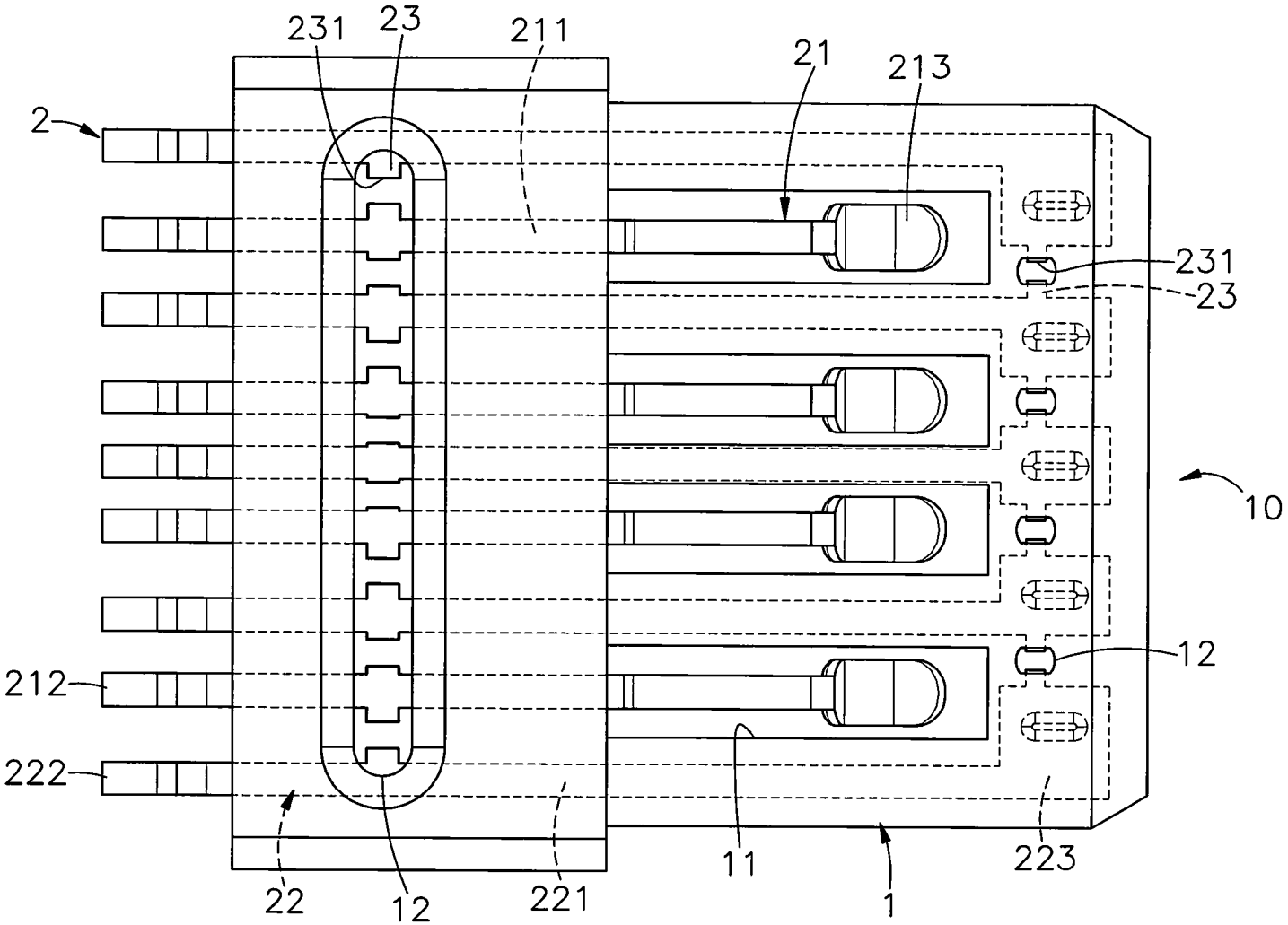
FIG. 5 is a schematic top view of the USB connector in accordance with the first embodiment of the present invention.
Figure 6:
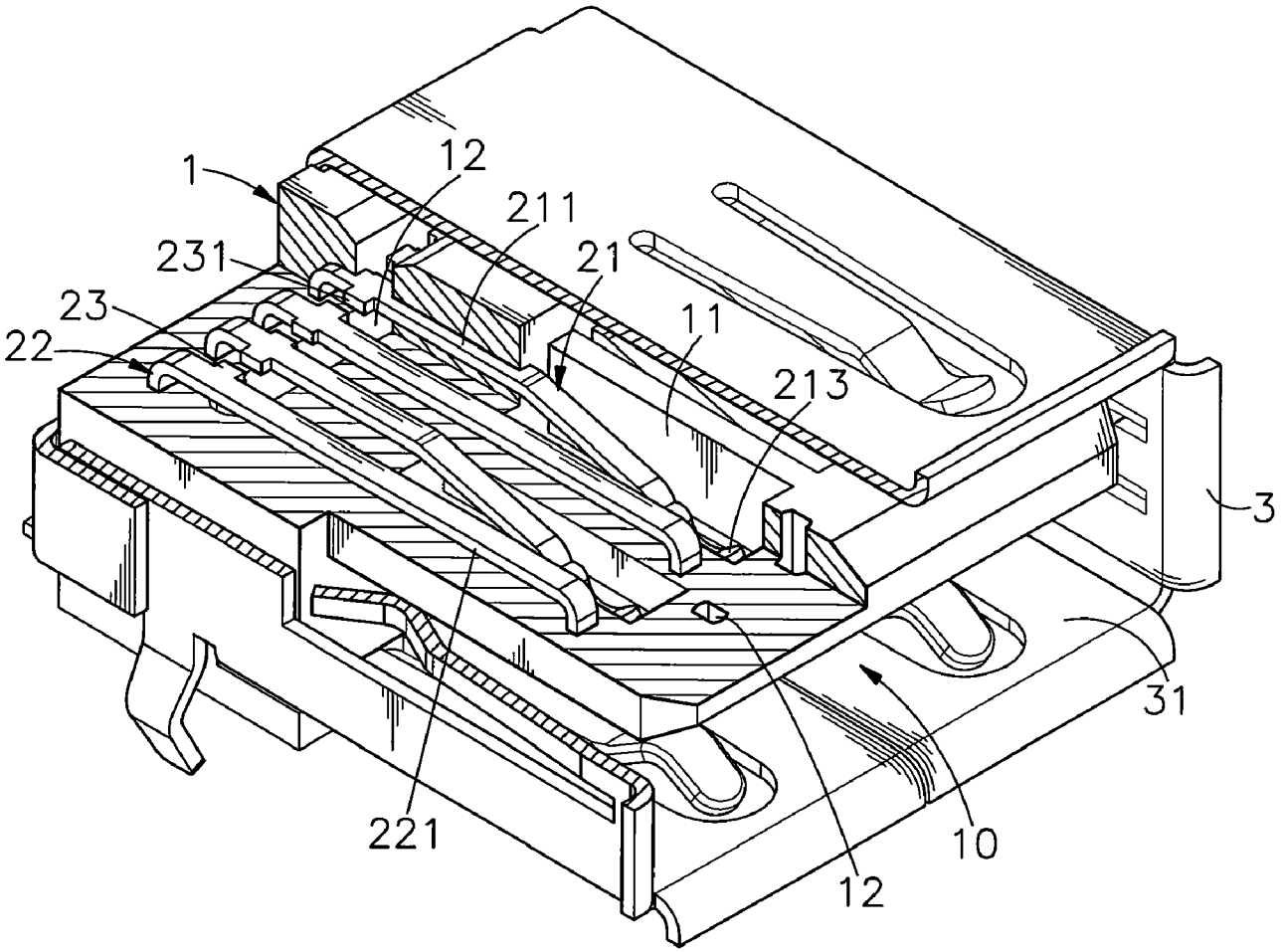
FIG. 6 is a sectional elevation of the USB connector in accordance with the first embodiment of the present invention.

Referring to FIG. 1 and FIG. 6, a USB (universal serial bus) connector in accordance with a first embodiment of the present invention is shown comprising an electrically insulative housing 1, a terminal set 2 and a metal shield 3.

The electrically insulative housing 1 defines a receiving space 10, a plurality of suspension slots 11 arranged in a parallel manner in communication with the receiving space 10 and a plurality of punch holes 12 arranged at front and rear sides relative to the suspension slots 11.

The terminal set 2 is mounted in the electrically insulative housing 1, comprising a set of first terminals 21, a set of second terminals 22 and a plurality of material bridges 23 joining the first terminals 21 and the second terminals 22. The first terminals 21 and the second terminals 22 are alternatively arranged in a row and connected to one another by the material bridges 23, each having a narrow elongated base portion 211 or 221, a rear bonding end portion 212 or 222 backwardly extended from one end, namely, the rear end of the narrow elongated base portion 211 or 221, and a front contact end portion 213 or 223 forwardly extended from the other end, namely, the front end of the narrow elongated base portion 211 or 221. The set of first terminals 21 is configured subject to a predetermined specification, for example, USB (Universal Serial Bus) 1.1 or 2.0, i.e., the number of the first terminals 21 can be four or five and the number of the second terminals 22 is five.

The metal shield 3 is hollow metal shell secured around the periphery of the electrically insulative housing 1 to shield the terminal set 2 against interference of external noises, having an opening 31 on its one side for the insertion of an external matching connector (not shown).

During installation, the narrow elongated base portions 211 and 221 of the set of first terminals 21 and the set of second terminals 22 are respectively suspending in the suspension slots 11 of the electrically insulative housing 1; the rear bonding end portions 212 and 222 of the set of first terminals 21 and the set of second terminals 22 are respectively extended out of the rear bottom side of the electrically insulative housing 1 for bonding to an external circuit board (not shown); the front contact end portions 213 and 223 of the set of first terminals 21 and the set of second terminals 22 are kept in the receiving space 10 of the electrically insulative housing 1 for the contact of respective terminals of an external matching connector (not shown); the material bridges 23 are respectively aimed at the punch holes 12 and then cut into separated bridge parts 231 that are respectively connected to the first terminals 21 and the second terminals 22 so that the first terminals 21 and the second terminals 22 are kept apart from one another.

Referring to FIGS. 2~5 and FIG. 6 again, the method for making the aforesaid USB (universal serial bus) connector includes the steps as follows:

(100) preparing a metal sheet and then stamping the metal sheet into a terminal set 2 comprising a set of first terminals 21, a set of second terminals 22, a plurality of material bridges 23 joining the first terminals 21 and the second terminals 22, and a transverse material strip 24 connected to the first terminals 21 and the second terminals 22 at a rear side by a breaking line 241 thereof wherein the first terminals 21 and the second terminals 22 are alternatively arranged in a row and connected to one another by the material bridges 23 and the transverse material strip 24, each having a narrow elongated base portion 211 or 221, a rear bonding end portion 212 or 222 backwardly extended from a rear end of the narrow elongated base portion 211 or 221 and connected to the transverse material strip 24 and a front contact end portion 213 or 223 forwardly extended from a front end of the narrow elongated base portion 211 or 221;

(101) preparing an electrically insulative housing 1 that defines a receiving space 10, a plurality of suspension slots 11 arranged in a parallel manner in communication with the receiving space 10 and a plurality of punch holes 12 arranged at front and rear sides relative to the suspension slots 11, and then mounting the terminal set 2 in the electrically insulative housing 1 to keep the material bridges 23 in vertical alignment with the punch holes 12;

(102) putting the assembly of the electrically insulative housing 1 and the terminal set 2 in a die punching machine (not shown) to attach the rear punch holes 12 of the electrically insulative housing 1 to respective punching dies 4 of the die punching machine, and then operating the die punching machine to drive the punching dies 4 through the material bridges 23 and to have the material bridges 23 be cut off so that separated bridge parts 231 are left and respectively connected to the first terminals 21 and the second terminals 22 and the first terminals 21 and the second terminals 22 are kept apart from one another;

(103) separating the material strip 24 from the first terminals 21 and the second terminals 22 along the breaking line 241; and (104) preparing a metal shield 3 having an opening 31 at a front side thereof and then securing the metal shield 3 around the periphery of the electrically insulative housing 1.

After the material bridges 23 have been cut into separated bridge parts 231 during the aforesaid fabrication procedure, the front contact end portions 213 and 223 of the first terminals 21 and the second terminals 22 are kept apart and the rear bonding end portions 212 and 222 of the first terminals 21 and the second terminals 22 are connected to the transverse material strip 24. The terminal set 2 is then fixedly installed in the electrically insulative housing 1 by means of insert molding or any known mounting techniques to keep the material bridges 23 in vertical alignment with the punch holes 12 respectively.

Further, after stamping of the prepared metal sheet into a terminal set 2, a transverse material strip 14 is formed connected to the rear bonding end portions 212 and 222 of the first terminals 21 and the second terminals 22, facilitating delivery of the terminal set 2.

Further, the stamped terminal set 2 can be bent into shape and then mounted in the electrically insulative housing 1. Alternatively, the stamped terminal set 2 can be mounted in the electrically insulative housing 1 at first and then bent into shape. However, it is to be understood that the main feature of the present invention is to use a press for stamping a metal sheet into a terminal set 2 that fits USB 3.0 standard, and then to use a die punching machine for cutting off the material bridges 23 of the terminal set 2. With respect to the status whether the transverse material strip 24 is kept connected to or separated from the terminal set 2 after formation of the terminal set 2, or the status whether the terminal set 2 is bent into shape after or before installation in the electrically insulative housing 1, the invention gives no limitation in all these regards.

Further, the rear bonding end portions 212 and 222 of the first terminals 21 and the second terminals 22 may be configured to fit for SMT (surface mount technology) or through hole mounting, i.e., the structure and configuration of the rear bonding end portions 212 and 222 are determined subject to user's requirements.

Figure 7:
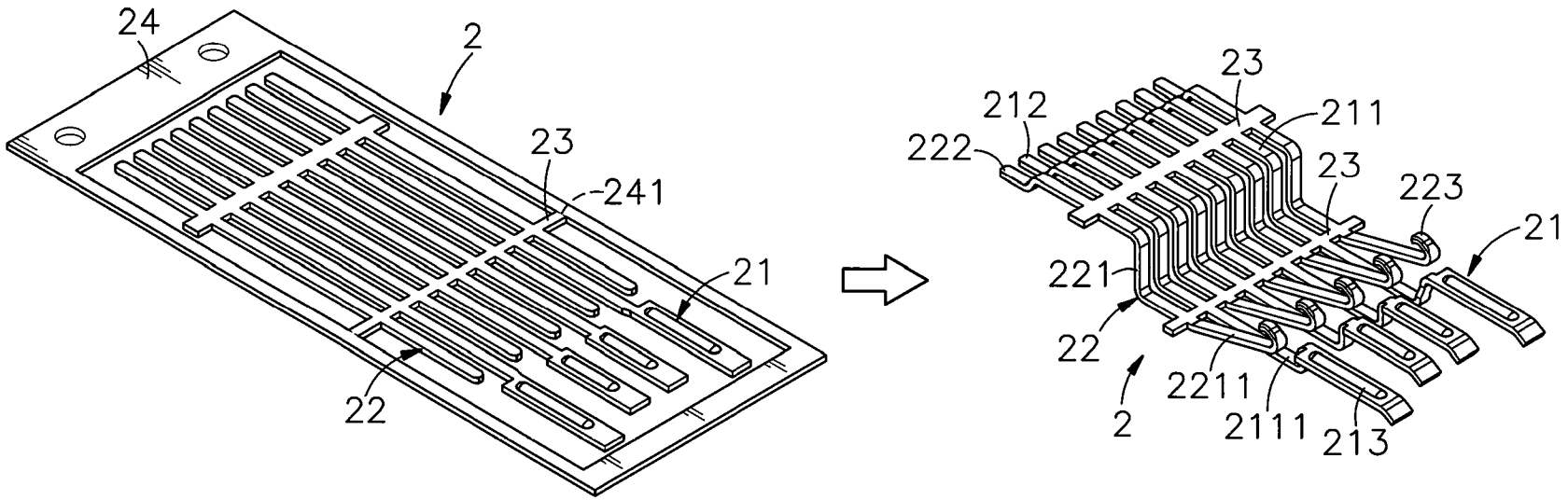
FIG. 7 is a schematic drawing, showing a terminal set bent into shape according to a second embodiment of the present invention.
Figure 8:
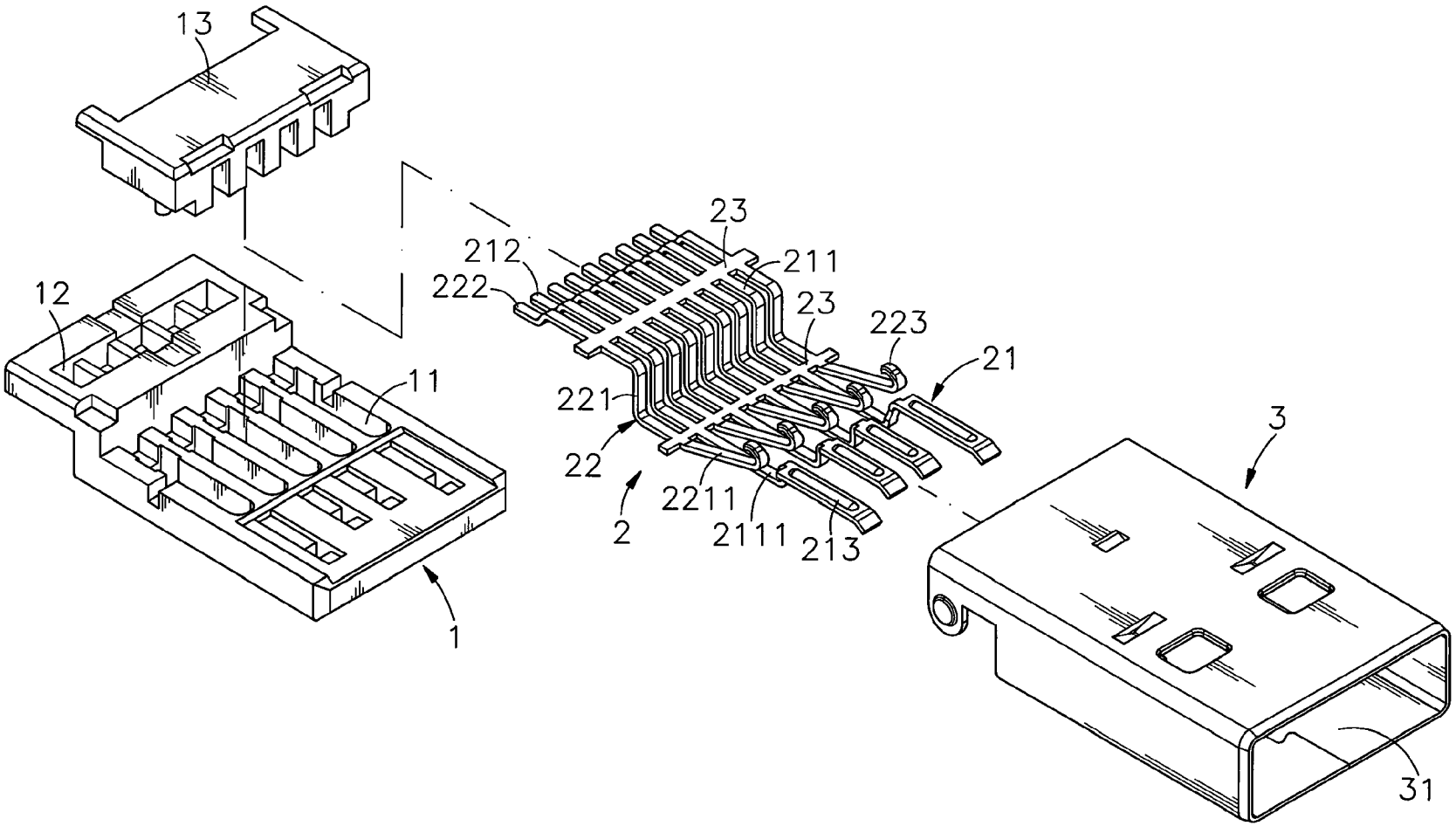
FIG. 8 is an exploded vi3w of a USB connector in accordance with the second embodiment of the present invention.
Figure 9A:
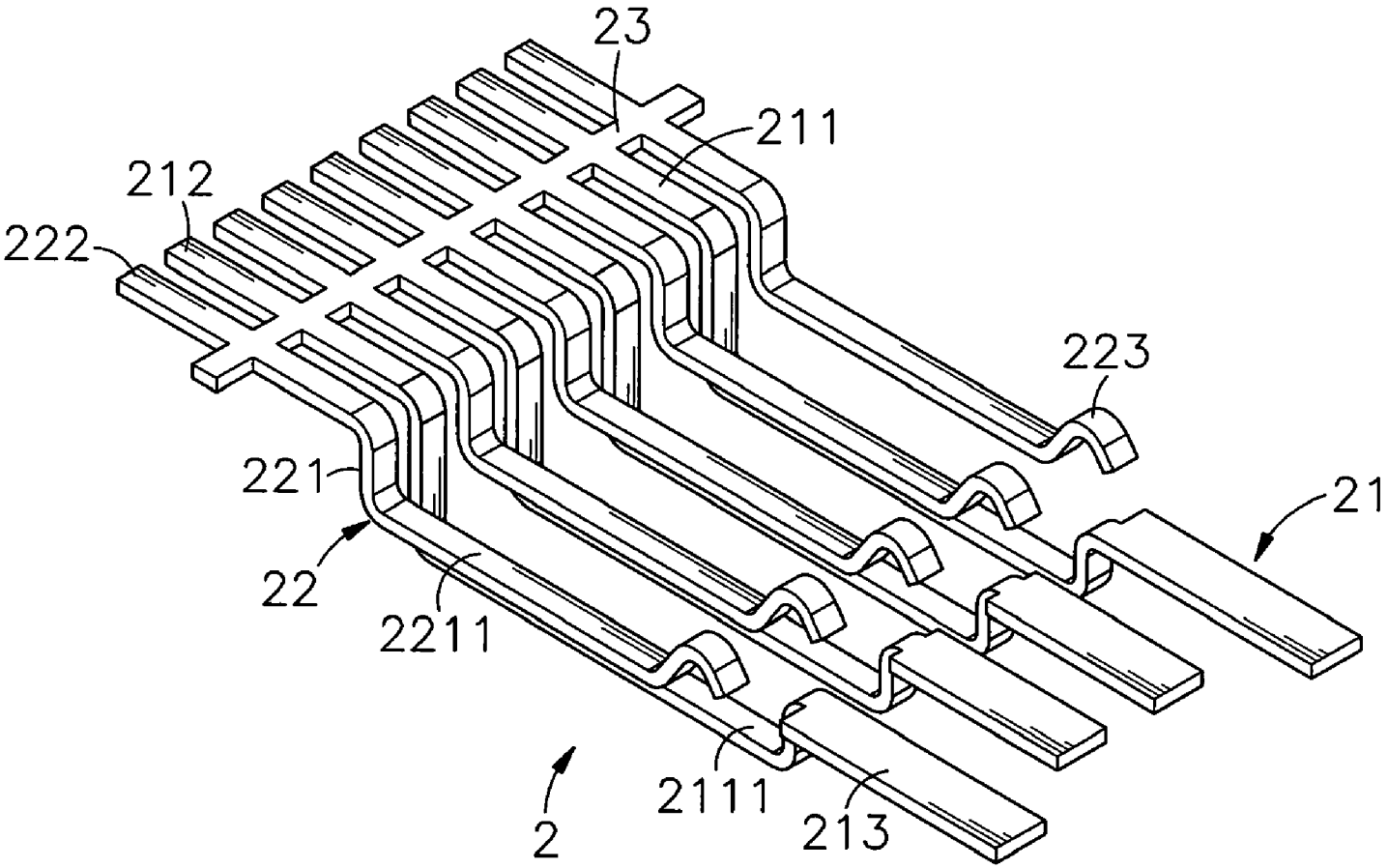
FIG. 9*a* is an elevational view of a terminal set for USB connector in accordance with a third embodiment of the present invention.
Figure 9B:
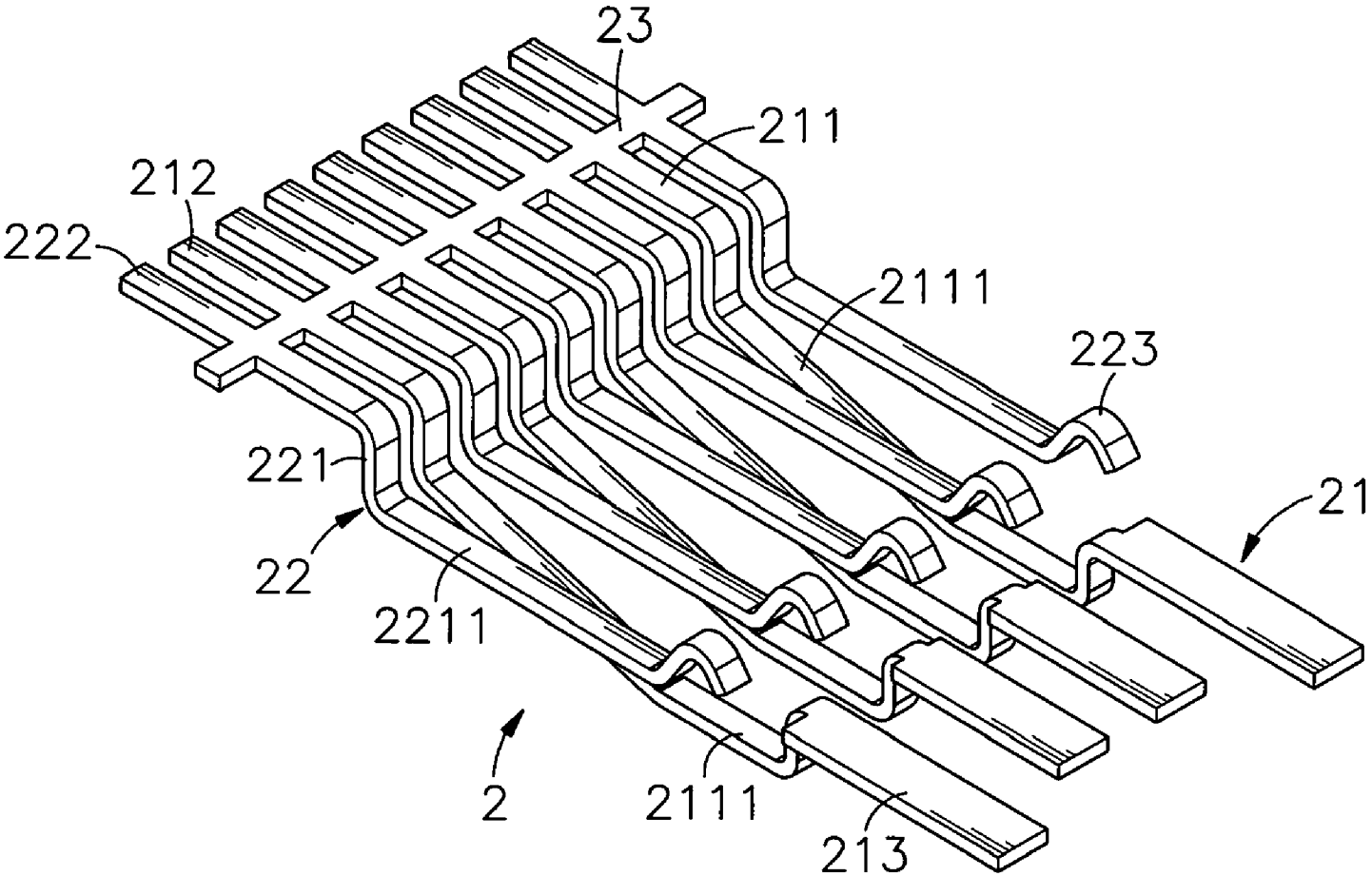
FIG. 9*b* is an elevational view of a terminal set for USB connector in accordance with a fourth embodiment of the present invention.
Figure 9C:
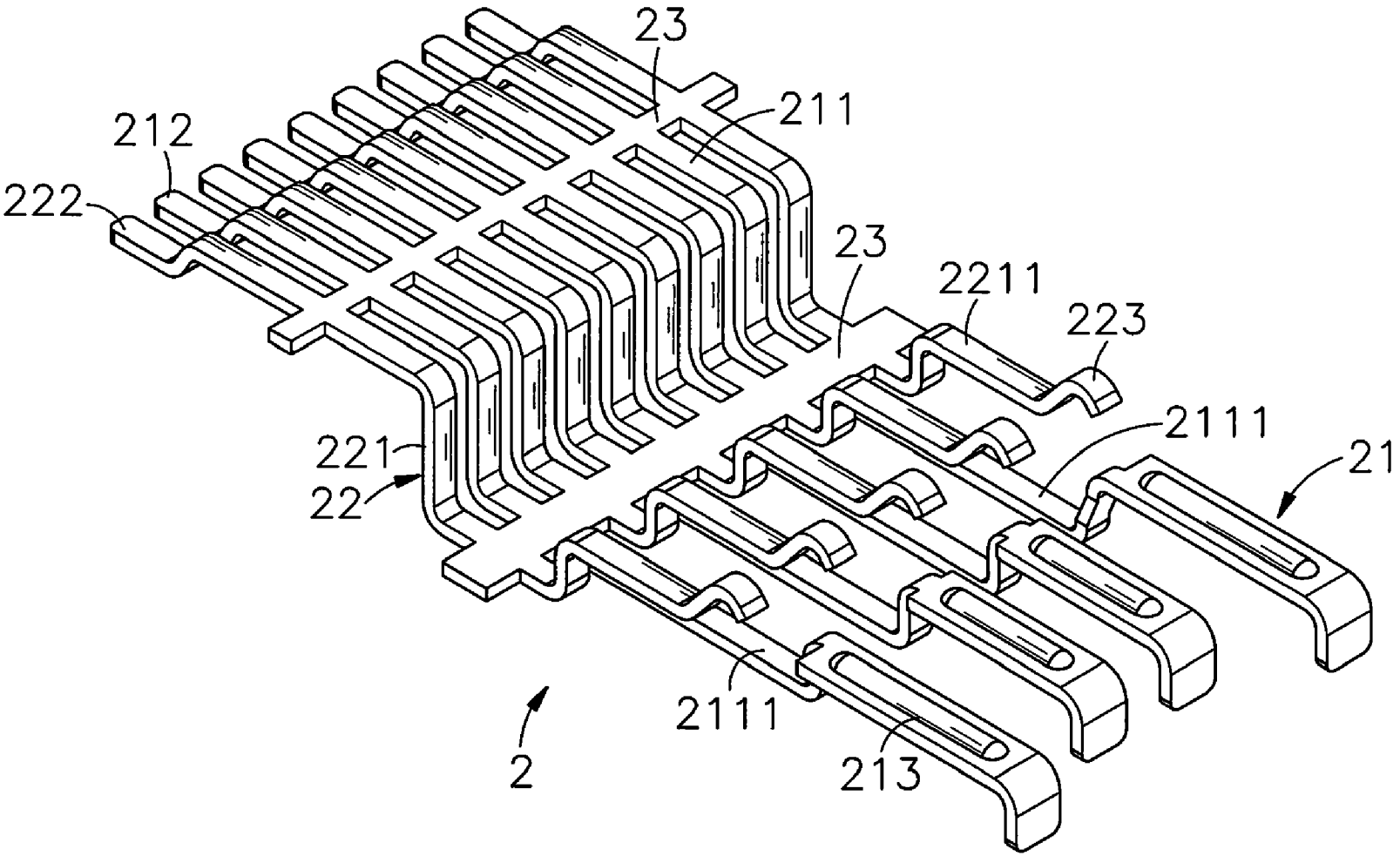
FIG. 9*c* is an elevational view of a terminal set for USB connector in accordance with a fifth embodiment of the present invention.
Figure 9D:
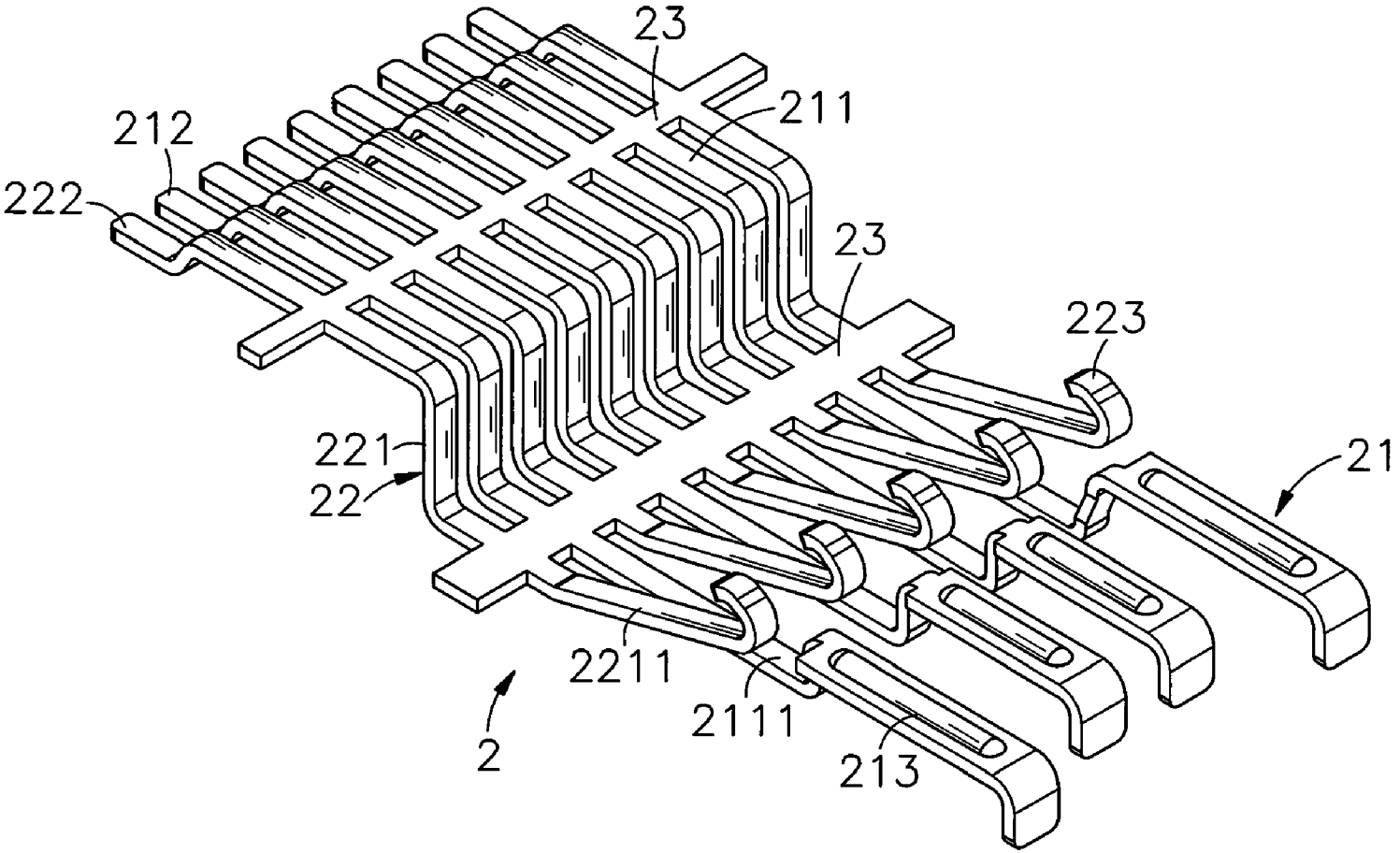
FIG. 9*d* is an elevational view of a terminal set for USB connector in accordance with a sixth embodiment of the present invention.
Figure 9E:
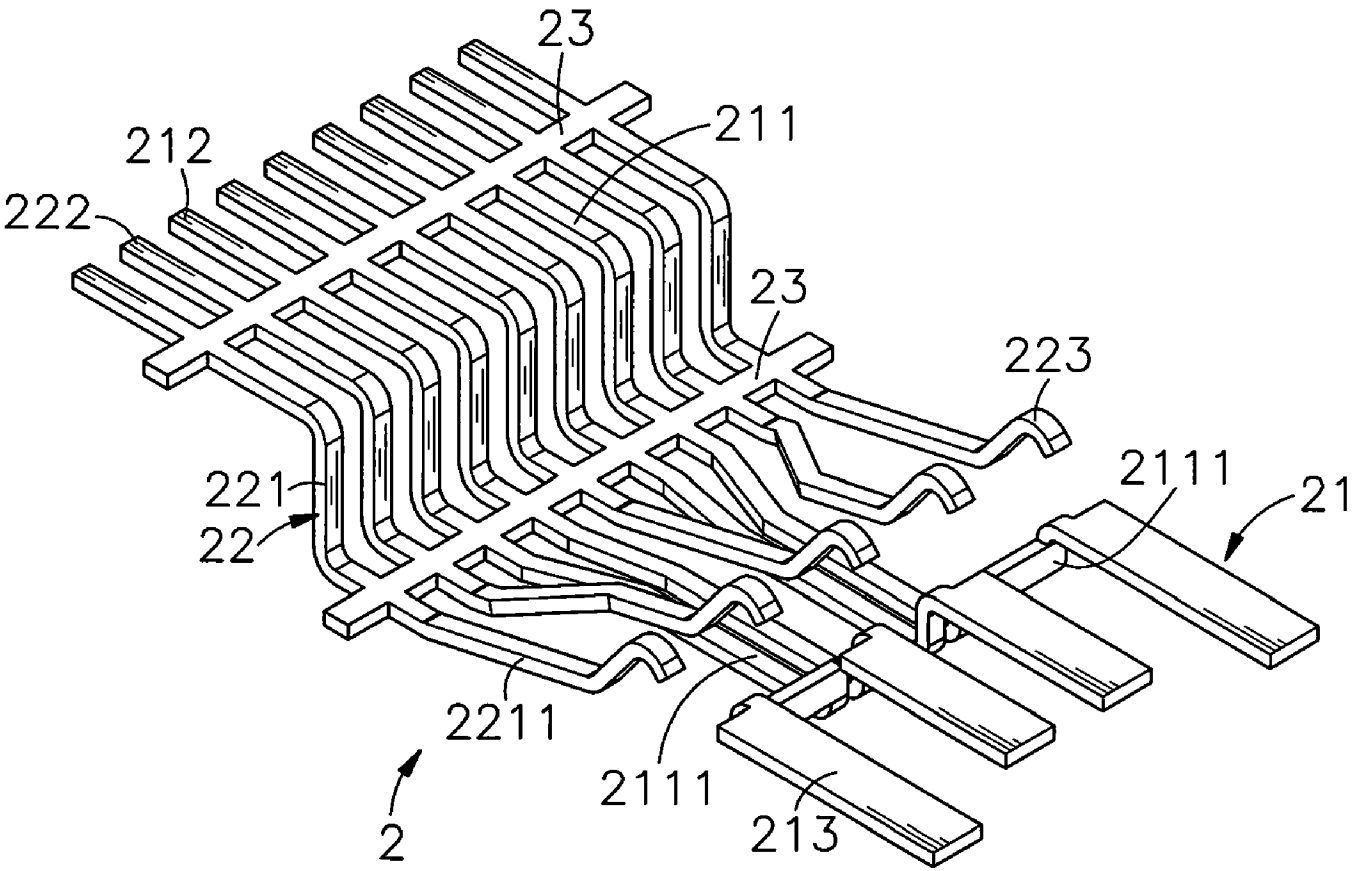
FIG. 9*e* is an elevational view of a terminal set for USB connector in accordance with a seventh embodiment of the present invention.

FIGS. 7 and 8 show a USB (universal serial bus) connector in accordance with a second embodiment of the present invention. According to this second embodiment, the first terminals 21 and the second terminals 22 each have a narrow elongated base portion 211 or 221, a rear bonding end portion 212 or 222 backwardly extended from the rear end of the narrow elongated base portion 211 or 221, and a front contact end portion 213 or 223 forwardly extended from the front end of the narrow elongated base portion 211 or 221, wherein the narrow elongated base portion 211 of each first terminal 21 has a front connection segment 2111 sloping upwardly forwards; the front contact end portion 213 of each first terminal 21 is shaped like a flat strip and extends forwardly from the front connection segment 2111 of the associating narrow elongated base portion 211 in horizontal and then sloping downwards; the narrow elongated base portion 221 of each second terminal 22 has a front connection segment 2211 sloping upwardly forwards; the front contact end portion 223 of each second terminal 22 curves upwardly backwards from the front connection segment 2211 of the associating narrow elongated base portion 221. Further, the electrically insulative housing 1 according to this second embodiment has an electrically insulative holding down block 13 arranged on the top side thereof to hold down the rear bonding end portions 212 and 222 of the first terminals 21 and the second terminals 22 on one same plane for bonding to an external cable or circuit board. Further, the front contact end portions 213 and 223 of the first terminals 21 and the second terminals 22 may be springy or rigid subject to requirements.

FIGS. 9*a*~9*e* illustrate further other alternate forms of the terminal set 2 fitting USB 3.0 male or female connector specifications. As illustrated, the front connection segments 2111 and 2211 of the narrow elongated base portions 211 and 221 of the first terminals 21 and the second terminals 22 that are respectively connected to the associating front contact end portions 213 and 223 can be configured to extend in horizontal or vertical, or to slop upwards, downwards or sideways.

The above descriptions are simply for easy understanding of the spirit and scope of the invention but not intended as limitations of the invention. As stated, the main feature of the present invention is to stamp a metal sheet into a terminal set 2 that comprises a plurality of first terminals 21 and a plurality of second terminals 22 alternatively arranged in an array, and a plurality of material bridges 23 joining the first terminals 21 and the second terminals 22 at locations corresponding to the punch holes 12 of the electrically insulative housing 1, and then to use a die punching machine for cutting off the material bridges 23 of the terminal set 2 after installation of the terminal set 2 in the electrically insulative housing 1. This method is practical for the production of male USB connector as well as female USB connector With respect to the status whether the transverse material strip 24 is kept connected to or separated from the terminal set 2 after formation of the terminal set 2, the status whether the terminal set 2 is bent into shape after or before installation in the electrically insulative housing 1, or the mounting design of the rear bonding end portions 212 and 222, the invention gives no limitation in all these regards In conclusion, the invention provides a USB connector and its fabrication method, having the advantages and benefits as follows:

1. By means of a press with one single die, a metal sheet is directly stamped into a terminal set 2 comprising a plurality of first terminals 21 and a plurality of second terminals 22 that have the respective front contact end portions 213 and 223 alternatively arranged in an array subject to USB 3.0 specification. Therefore, the invention eliminates the problem of creating two different dies for making the first terminals 21 and the second terminals 22 separately, saving much die cost.
2. Unlike conventional techniques of using two different metal sheets for making first and second terminals, the invention uses one single metal sheet to make the first terminals 21 and the second terminals 22, saving much material cost. Further, by means of the material bridges 23 to join the first terminals 21 and the second terminals 22, the invention facilitates installation of the terminal set 2 in the electrically insulative housing 1, saving much fabrication time and installation cost.
3. An electrically insulative holding down block 13 can be arranged on the top side of the electrically insulative housing 1 to hold down the rear bonding end portions 212 and 222 of the first terminals 21 and the second terminals 22 on one same plane, facilitating accurate bonding of the rear bonding end portions 212 and 222 to an external cable or circuit board.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A USB connector fabrication method, comprising the steps of:

(A) preparing a metal sheet and then stamping said metal sheet into a terminal set comprising a set of first terminals, a set of second terminals and a plurality of material bridges joining said first terminals and said second terminals wherein said first terminals and said second terminals are alternatively arranged in a row and connected to one another by said material bridges, each having a narrow elongated base portion, a rear bonding end portion backwardly extended from a rear end of said narrow elongated base portion and a front contact end portion forwardly extended from a front end of said narrow elongated base portion;

(B) preparing an electrically insulative housing that defines a receiving space, a plurality of suspension slots arranged in a parallel manner in communication with said receiving space and at least one punch hole, and then mounting said terminal set in said electrically insulative housing to keep said material bridges in vertical alignment with said at least one punch hole;

(C) putting the assembly of said electrically insulative housing and said terminal set in a machine and then operating said machine to cut off said material bridges;

(D) preparing a metal shield having an opening at a front side thereof and then securing said metal shield around the periphery of said electrically insulative housing.

2. The USB connector fabrication method as claimed in claim 1, wherein the front contact end portion of each said first metal terminal is springy.

3. The USB connector fabrication method as claimed in claim 1, wherein the front contact end portion of each said second metal terminal is springy.

4. The USB connector fabrication method as claimed in claim 1, wherein said terminal set further comprises a transverse material strip having a breaking line connected to the rear bonding end portions of said first terminals and said second terminals, said material strip being separated from said first terminals and said second terminals by breaking said breaking line after cutting of said material bridges by said machine.

5. The USB connector fabrication method as claimed in claim 1, wherein said terminal set is bent into a predetermined shape and then mounted in said electrically insulative housing.

6. The USB connector fabrication method as claimed in claim 1, wherein said terminal set is bent into a predetermined shape after mounted in said electrically insulative housing.

7. The USB connector fabrication method as claimed in claim 1, wherein said first terminals are selectively configured subject to one of USB 1.1 and 2.0 specifications, and the number of said first terminals is 4 or 5; the number of said second terminals is 5; said second terminals and said first terminals are arranged to fit USB 3.0 standard.

8. The USB connector fabrication method as claimed in claim 1, wherein the rear bonding end portions of said first terminals and said second terminals are configured to fit one of SMT (surface mount technology) and through-hole mounting techniques.

9. A USB connector, comprising:

an electrically insulative housing, said electrically insulative housing defining a receiving space, a plurality of suspension slots arranged in a parallel manner in communication with said receiving space and at least one punch hole in communication with said receiving space;

a terminal set mounted in said electrically insulative housing, said terminal set comprising a set of first terminals, a set of second terminals and a plurality of material bridges joining said first terminals and said second terminals and aimed at said at least one punch hole of said electrically insulative housing for cutting by an external tool means after installation of said terminal set in said electrically insulative housing, said first terminals and said second terminals being alternatively arranged in a row and connected to one another by said material bridges, each of said first terminals and said second terminals having a narrow elongated base portion, a rear bonding end portion backwardly extended from a rear end of said narrow elongated base portion and a front contact end portion forwardly extended from a front end of said narrow elongated base portion; and a metal shield secured around the periphery of said electrically insulative housing, said metal shield having an opening in communication with said receiving space of said electrically insulative housing.

10. The USB connector as claimed in claim 9, wherein the front contact end portion of each said second terminal is selectively configured to extend horizontally or to curve upwards or downwards.

11. The USB connector as claimed in claim 9, wherein the front contact end portion of each said first terminal is selectively configured to extend horizontally or to curve upwards.

12. The USB connector as claimed in claim 11, wherein the front contact end portion of each said second terminal is selectively configured to slope downwardly forwards or to curve vertically downwards.

13. The USB connector as claimed in claim 9, wherein the narrow elongated base portion of each of said first terminals and said second terminals has a front connection segment connected to the associating front contact end portion.

14. The USB connector as claimed in claim 13, wherein said front connection segment is selectively configured to extend horizontally forward, vertically upwards, obliquely forwards or obliquely sideways.

15. The USB connector as claimed in claim 9, wherein said electrically insulative housing comprises an electrically insulative holding down block arranged on a top side thereof to hold down the rear bonding end portions of said first terminals and said second terminals on a same plane.

16. The USB connector as claimed in claim 9, wherein said first terminals are selectively configured subject to one of USB 1.1 and 2.0 specifications so that the number of said first terminals is 4 or 5; the number of said second terminals is 5; said second terminals and said first terminals are arranged to fit USB 3.0 standard.

17. The USB connector as claimed in claim 9, wherein the front contact end portion of each said first metal terminal is springy.

18. The USB connector as claimed in claim 9, wherein the front contact end portion of each said second metal terminal is springy.

19. The USB connector as claimed in claim 9, wherein the rear bonding end portions of said first terminals and said second terminals are configured to fit one of SMT (surface mount technology) and through-hole mounting techniques.

* * * * *